US006067733A

United States Patent [19]

Gasper

[11] Patent Number: 6,067,733

[45] Date of Patent: May 30, 2000

[54] DITCH TRENCHING DEVICE

[76] Inventor: Walter Gasper, 10199 Washington Ave., N. Huntingdon, Pa. 15642

[21] Appl. No.: 08/959,341

[22] Filed: Apr. 13, 1998

[51] Int. Cl.[7] ..... E02F 5/02; E02F 3/75; E02F 3/40; E02D 17/13

[52] U.S. Cl. ..... 37/367; 37/347; 37/380; 37/404; 37/408; 37/444; 37/903

[58] Field of Search ..... 37/347, 379, 380, 37/403, 404, 408, 411, 444, 903, 367

[56] References Cited

U.S. PATENT DOCUMENTS

| | | | |
|---|---|---|---|
| 63,952 | 4/1867 | Smawley | 37/380 |
| 94,303 | 8/1869 | Gore | 37/380 |
| 2,364,657 | 12/1944 | Proctor et al. . | |
| 3,305,952 | 2/1967 | Dressler . | |
| 4,896,444 | 1/1990 | Sieber et al. | 37/118 R |
| 5,416,990 | 5/1995 | Otwell | 37/445 |
| 5,615,499 | 4/1997 | McGuire . | |

*Primary Examiner*—Eileen Dunn Lillis
*Assistant Examiner*—Gary S. Hartmann
*Attorney, Agent, or Firm*—Jon M. Lewis

[57] ABSTRACT

A ditch trenching device is adapted to be connected to earth moving equipment that use buckets. A dirt port is dimensioned in a lower portion of a bucket. A trencher is attached to the dirt port and is defined by two side members each with a front, back, top, and floor that are spaced apart the width of the dirt port; a floor member with a distal end is attached to the floors; and a back member is attached to the backs. There is an acute angle between the front and floor. A first cutting edge is placed at the distal end and a second cutting edge is connected to the front by the floor.

1 Claim, 3 Drawing Sheets

13
11
1
29
27
36
37
26

DITCH TRENCHING DEVICE

FIELD OF INVENTION

This invention relates to using earth moving equipment that use buckets such as bulldozers, skid loaders, and the like to dig a trench.

BACKGROUND OF THE INVENTION

Ditches are dug for many uses in construction industry such as laying pipe, tubes, wires, providing drainage among other reasons. Presently there are many types of machines that are used for digging trenches including back hoes, skid loaders, and trenching devices such as that disclosed in method and apparatus for trenching, U.S. Pat. No. 5,615, 499.

Presently available trenching machines are generally slow in use and many are difficult to maneuver. Digging a trench of desired depth that is even width throughout is difficult to maintain and control. Often with some equipment such as a back hoe, multiple operations are required to remove and place dirt while digging, as well as the necessity for moving equipment.

It is the design of the present invention to provide for relatively simple, easily operable ditch trenching device which can be readily attached to existing earth moving equipment that uses buckets such as a front end loaders or skid loaders. It is desirable to provide a device that can be operated at any construction site that will consistently form a trench with desired length, depth, and width. Since buckets are readily removable from any earth moving equipment, this device would be readily and efficiently removable and attachable just as an existing bucket.

SUMMARY OF THE INVENTION

The present invention advantageously provides an improved ditch trenching device which is attachable to any well known earth moving equipment that uses buckets. It is especially designed for relatively narrow trenches. The device is easily used to dig trenches to required depth, length, and width.

It is an object of the invention to provide a modification of a bucket used by existing earth moving equipment, such as a skid loader by providing a dirt port in a lower portion of the bucket. The dirt port would be of the width of a desired trench. A trencher is attached to the dirt port that is defined by two side members, each having a front, back, bottom, and floor, that is attached to the dirt port. The side members are spaced of equal width, the width of the dirt port. A floor member is attached to the floors and a back member is attached to the backs to define the trencher.

The floor member is provided with a distal and a proximal end. A first cutting edge is placed on the distal end. It may also be provided with teeth that are replaceable. A second cutting edge is placed on the front of each side member close to the floor. These cutting edges and teeth provide an adequate and advantageous cutting presentation to dig dirt. An acute angle is dimensioned between the front and floor of the side members. This acute angle on the resultant trencher provides in use an adequate device to dig trenches. It has the additional advantage of providing leverage to dislodge hard objects such as stones, and other foreign objects such as pipes.

To strengthen the trencher, a support brace is placed to the outside of the back member, a skid is placed on the outside of the floor member, and a front brace is placed on the front of each side member. To assist the movement of dirt up into the dirt port, a back brace is placed inside the trencher and attached to the floor member and the back member. The result, in use provides an operator with a cutting presentation that goes through dirt, forces dirt and debris into the trencher. The dirt is focused through the dirt port and into the bucket.

The floor member is preferably parallel to the lower portion of the bucket. Automatic levelers are available with conventional earth moving equipment. When the operator places the present invention into the proper depth of dirt, because the levelers are the advantageous use of my invention, the operator need only direct the machine to go in the desired travel direction. By using my invention, the operator digs a trench of desired width, depth, and length.

BRIEF DESCRIPTION OF THE DRAWINGS

The invention will become better understood by reference to the following detailed description of the preferred embodiment when read in conjunction with the appended drawing wherein like numerals denote like elements.

DETAILED DESCRIPTION OF THE DRAWINGS

Figure 1:
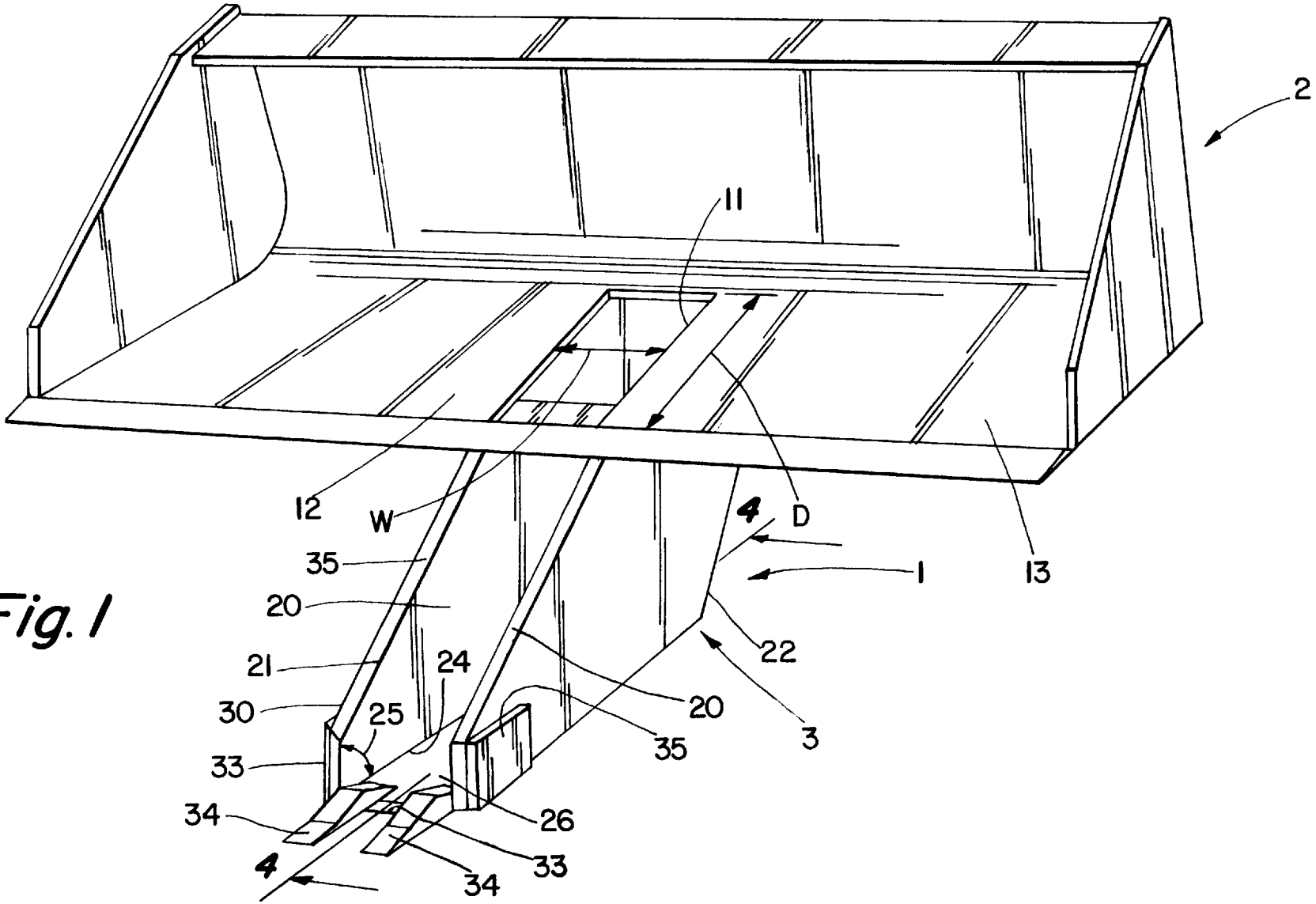
FIG. 1 is a perspective elevational view of the present invention.

This invention is for use with earth moving equipment that use buckets. Referring to FIG. 1, a ditch trenching device 1 is shown mounted to a bucket 2 that is attachable to existing earth moving equipment. A dirt port 11 is dimensioned in a mid section 12 of a lower portion 13 of the bucket 2. The dirt port 11 is sized to be substantially the depth D of the bucket of bucket 2 and whose width W is the desired width of a trench.

A trencher 3 is attached to the dirt port. It is preferably fabricated of a heavy duty welded metal construction that includes two side members 20, each having as disclosed in FIG. 2, a front 21, back 22, top 23, and floor 24. The floor 24 is designed with an acute angle 25 between the front 21 and the floor 24 of the side members 20.

Referring to FIG. 1 again, the side members 20 are spaced apart and attached to the bucket 2 at the location of dirt port 11. They are spaced apart the width W of the port 11.

Referring again to FIG. 2, a back member 27 is attached to the back 22 of each of the side member 20. A back member 27 is also disclosed in FIG. 3 to show its relative location. The back member 27 would be attached to the dirt port 11 as disclosed in FIG. 1.

Figure 2:
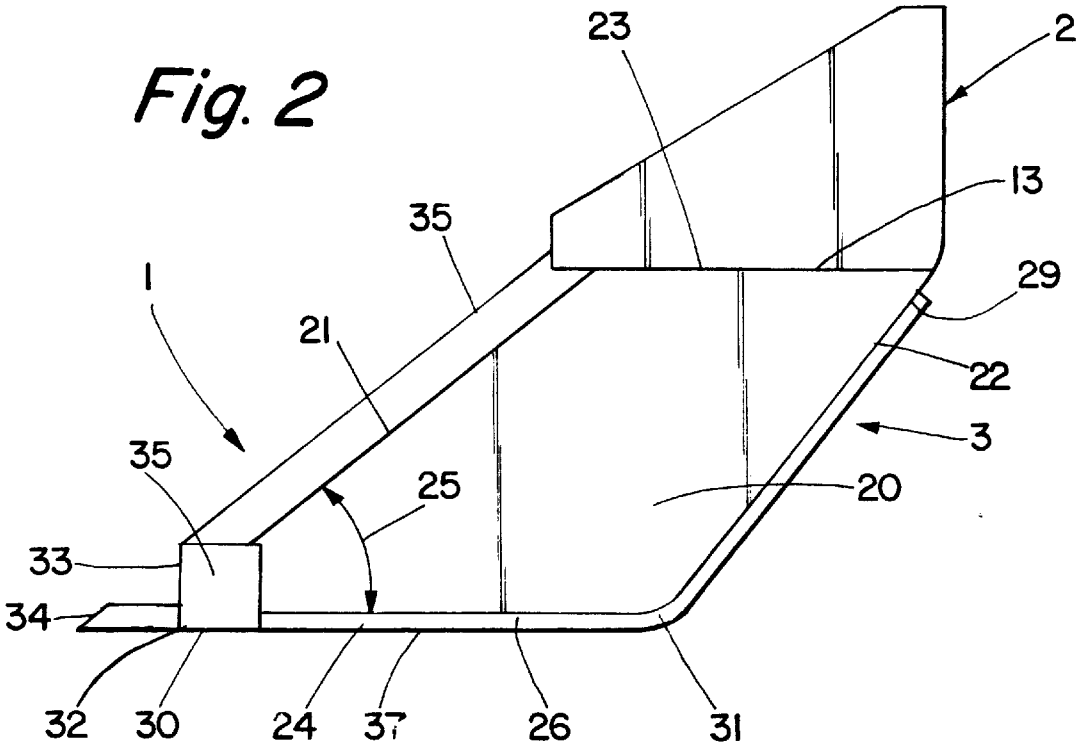
FIG. 2 is a side view of the present invention.

Referring to FIGS. 1 and 2, a floor member 26 is attached to the floor 24 of each side member 20. It is preferred in use that the back 22 and front 21 of the side members 20 are generally parallel to one another as disclosed in FIG. 2.

Figure 3:
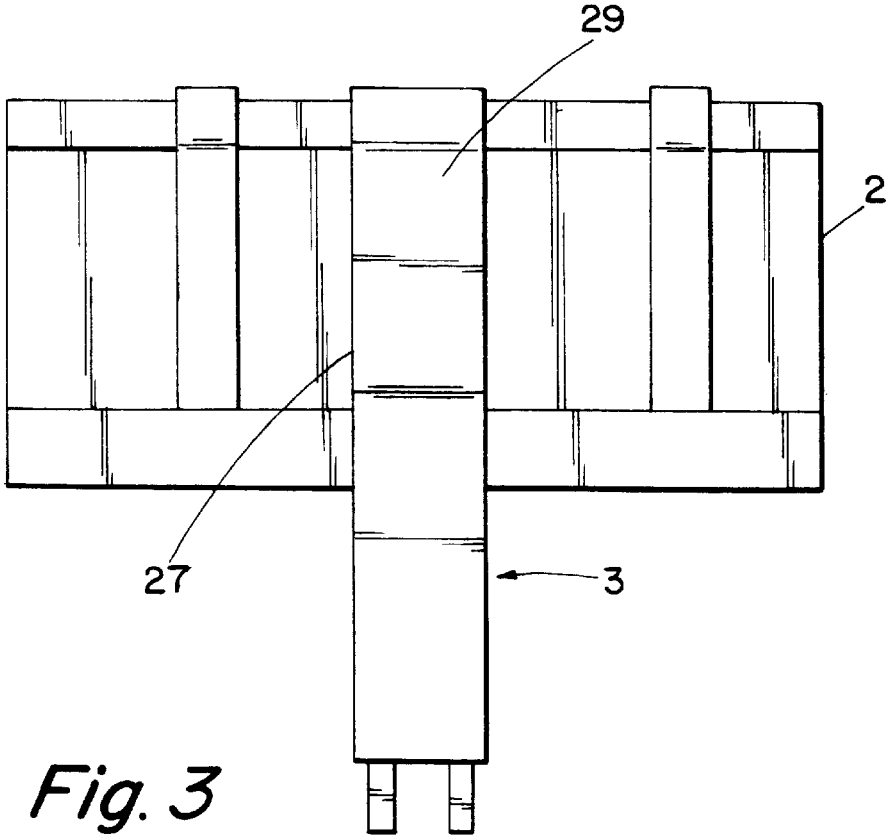
FIG. 3 is a back view of the present invention.

The trencher 3 as disclosed in FIG. 3, is dimensioned the width of a desired trench. It is preferred that the floor 24 of the side members 20 as disclosed in FIG. 2 would be parallel to the lower portion 13 of the bucket 2. Existing earth moving equipment have levelers so that a bucket would stay at a preset location while in use. This is important so that the trencher 3 will also stay at a preset location in use (which defines the depth of a trench).

The resulting ditch trenching device 1 as shown in FIG. 1, is used in such a manner that when the machine is in use, dirt or other debris goes through the side members 20 up and through the dirt port 11 to bucket 2 in a continual motion. It is important to have an acute angle 25 between the front 21 and the floor 24 of the side members 20 so that an appropriate angle is made to assist the digging process.

Referring to FIG. 2, floor member 26, attached to floor 24, is disclosed having a distal end 30 and a proximal end 31. As shown in FIGS. 1 and 2, a first cutting edge 32 is placed on the distal end 30. A second cutting edge 33 is placed on that portion of the front 21 of side members 20 that is close to the floor 24.

Referring to FIG. 1, teeth 34 are attached to the cutting edge 32 or could be attached to the floor member 26. By looking at FIG. 1, one can see an advantageous presentation of first cutting edge 32, second cutting edge 33, and teeth 34. This provides an advantageous presentation for cutting dirt. Said teeth 34 are replaceable as they would wear in use.

Referring again to FIG. 2, front brace 35 is attached to the front 21 of side members 20 for purposes of strength. Skid 37, as shown in FIGS. 4 and 2, is placed on the outside portion of floor member 26 to strengthen the floor.

Figure 4:
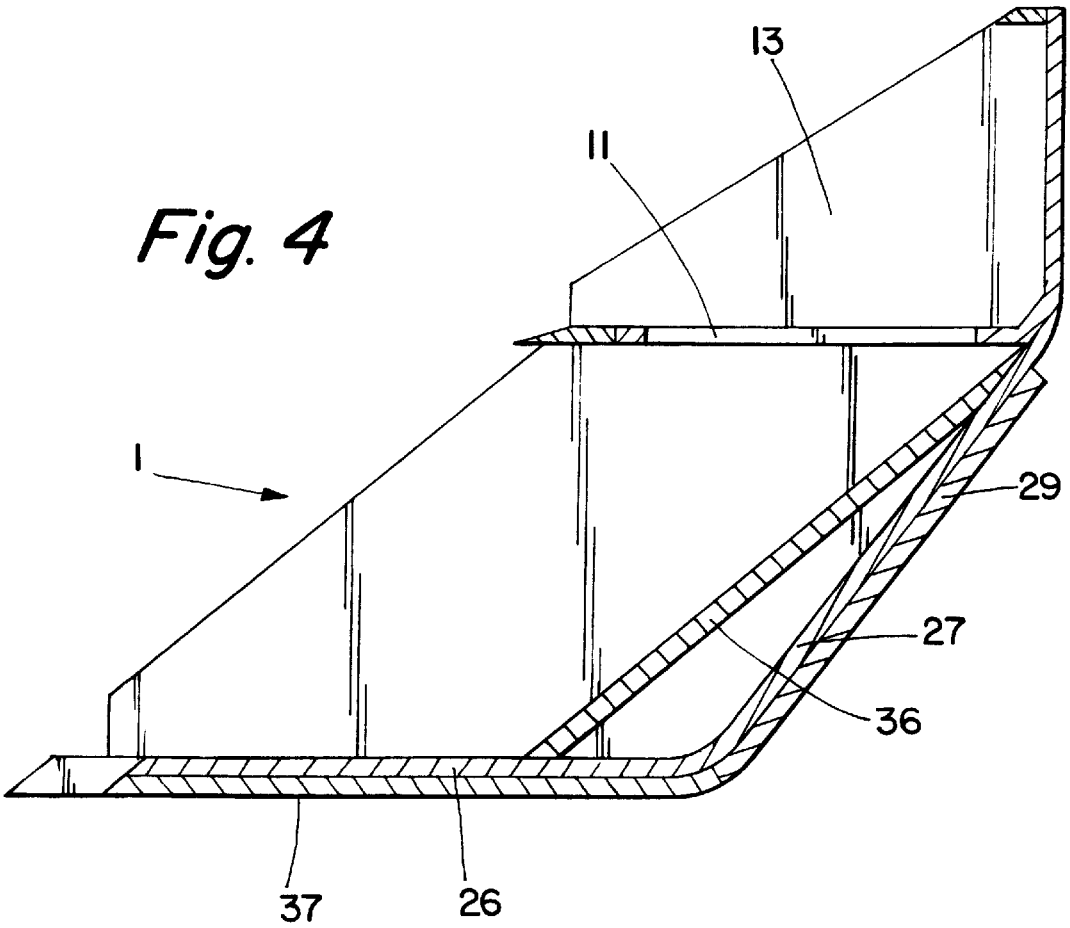
FIG. 4 is a partial sectional view taken along lines 4—4 of FIG. 1.

Referring to FIG. 4, back brace 36 is placed between floor member 26 and back member 27 to assist the flow of dirt up and into the port as well as to provide additional strength.

Referring to FIGS. 2 and 3, support brace 29 is placed on back member 27. The purpose of the back brace is again to strengthen the trencher 3 in use.

It should be appreciated that the present invention provides an improved ditch trenching device 1 that digs the desired trench, removes dirt from the trench in a quick manner without the need for complicated mechanical or hydraulic components. Once the ditch trenching device 1 is placed into the earth and earth moving equipment start moving forward, a desired trench is dug the appropriate width and length as needed. The depth would be preset by the operator and would be level with the bucket as leveling devices with existing earth moving equipment would keep the floor member 26 level with the bucket 2. The result would be that the bottom of a trench has a level floor of desired dimension.

While this invention has been described with reference to the preferred embodiment, anyone skilled in the art will appreciate that certain substitutions alterations changes and equivalents may be made without departing from the sphere hereof. Accordingly, the foregoing description of the preferred embodiment is meant to be, for example only and should not be deemed limiting the scope of the invention set forth in the following claims.

What is claimed as new is as follows:

1. A ditch trenching device for earth moving equipment that uses buckets and optionally front end loader buckets and skid loader buckets comprising:

a bucket having an upper portion and a lower portion and attachable to earth moving equipment, the lower portion of the bucket having a depth and width;

a dirt port dimensioned in a mid section of a lower portion of said bucket, said port is sized to be substantially the depth of said bucket and its width is a size of a desired trench;

a trencher attached to said dirt port having a depth substantially the same as said depth of said bucket and a width less than said width of said bucket for digging said trench whereby said width creates said trench for laying pipe, tubes, cable and wires;

at least two side members each having a front, a back, top, and floor, and being spaced apart and attached to said bucket at a location of said port and spaced apart said width of said port, said floor being generally parallel to said lower portion of said bucket and having an acute angle between said front and floor of said side members, wherein said floor of each side member has a distal and proximal end;

a first cutting edge placed on said distal end of said floor having teeth attached to said first cutting edge;

a second cutting edge attached to the front of each side member;

a front brace attached to the front of each of said side members to strengthen said sides;

a back brace placed between said sides and connected to said floor and said back;

a skid placed on an outside portion of said floor; and a support brace attached to an outside portion of said back brace.

* * * * *